US007798868B2

(12) United States Patent
Borona et al.

(10) Patent No.: US 7,798,868 B2
(45) Date of Patent: Sep. 21, 2010

(54) ELECTRICAL SWITCHING APPARATUS AND TERMINAL CONNECTOR ASSEMBLY THEREFOR

(75) Inventors: Russell T. Borona, Gurabo, PR (US); Hoyma J. Mazara, Santo Domingo (DO)

(73) Assignee: Eaton Corporation, Cleveland, OH (US)

( * ) Notice: Subject to any disclaimer, the term of this patent is extended or adjusted under 35 U.S.C. 154(b) by 96 days.

(21) Appl. No.: 12/349,557

(22) Filed: Jan. 7, 2009

(65) Prior Publication Data

US 2010/0173541 A1 Jul. 8, 2010

(51) Int. Cl.
*H01R 11/09* (2006.01)

(52) U.S. Cl. ..... 439/723; 335/202

(58) Field of Classification Search ..... 439/891, 439/723, 724, 709, 716, 797, 517–518, 812–814, 439/810; 335/8, 202, 132; 361/648, 652, 361/822, 826

See application file for complete search history.

(56) References Cited

U.S. PATENT DOCUMENTS 5,488,337 A * 1/1996 Hubbard et al. ..... 335/202
5,831,498 A 11/1998 Maloney et al.
6,280,264 B1 8/2001 Whipple et al.
6,781,491 B2 * 8/2004 Whipple et al. ..... 335/202
6,920,038 B2 7/2005 Gehlbach
7,132,913 B2 11/2006 Whipple et al.
7,495,534 B2 * 2/2009 Oh ..... 335/6

* cited by examiner

*Primary Examiner*—Edwin A. Leon
(74) *Attorney, Agent, or Firm*—Martin J. Moran

(57) ABSTRACT

A terminal connector assembly is provided for an electrical switching apparatus, such as a circuit breaker. The terminal connector assembly includes an electrically conductive member having opposing connecting and terminal portions, and a housing having a divider. The connecting portion is electrically connected to a power conductor of the circuit breaker. The divider includes first and second sides and an aperture extending therebetween. A plurality of walls extend perpendicularly outwardly from the first side of the divider to form a cavity, and a plurality of projections extend outwardly from the second side of the divider to engage and align the housing and the electrically conductive member with respect to the molded casing of the circuit breaker. The connecting portion of the electrically conductive member extends through the aperture of the divider and outside of the housing. The remainder of the electrically conductive member is disposed within the cavity.

21 Claims, 5 Drawing Sheets

ELECTRICAL SWITCHING APPARATUS AND TERMINAL CONNECTOR ASSEMBLY THEREFOR

BACKGROUND

1. Field

The disclosed concept relates generally to electrical switching apparatus and, more particularly, to electrical switching apparatus, such as circuit breakers. The disclosed concept also relates to terminal connector assemblies for circuit breakers.

2. Background Information

Electrical switching apparatus include, for example, circuit switching devices; circuit interrupters, such as circuit breakers; network protectors; contactors; motor starters; motor controllers; and other load controllers.

Circuit breakers are used to protect electrical circuitry from damage due to an overcurrent condition, such as an overload condition or a relatively high level short circuit or fault condition. For small power switches, which are commonly referred to as miniature circuit breakers, and which are used, for example, in residential and light commercial electrical distribution systems, the connector assembly for electrically connecting the power conductor of the miniature circuit breaker to the electrical conductors (e.g., without limitation, wires; cables) of the distribution system typically includes a collar terminal. Specifically, for example, the power conductor of the miniature circuit breaker is a relatively rigid, flat conductor, and the collar terminal generally includes a cylindrical or square body having a transverse slot in which the flat power conductor of the circuit breaker and the wire or cable are received, and a tapped bore into which a screw is threaded to clamp the wire or cable against the power conductor and to secure the collar to the power conductor. Typically, the collar terminal is disposed in a recess at a corresponding end of the circuit breaker molded casing.

In some applications, for example and without limitation, where space and/or accessibility is limited, it is desirable to have a quick connection for relatively quickly and easily connecting the wires or cables to the power conductors of the circuit breaker, preferably without the need to use a separate tool (e.g., without limitation, a screwdriver). It is also desirable to be able to relatively quickly and easily adapt the terminal connector assembly so that multiple wires or cables can be electrically connected to the same power conductor, preferably without having to clamp the multiple wires with a single collar connector.

U.S. Pat. No. 6,781,491 discloses one such quick connect terminal connector assembly. However, it is relatively complex in design and function. Specifically, a molded housing is secured to a circuit breaker by a mount including lips and latches having hooks. A terminal member, which includes spade terminations that extend outwardly from side edges of the terminal member through slots in the molded housing, is secured to the housing by a retainer and a molded pin. The retainer includes opposing catches, which compress to engage opposite edges of a rectangular opening in the terminal member. The molded pin extends outwardly from the housing through another different aperture in the terminal member.

There is, therefore, room for improvement in electrical switching apparatus, such as circuit breakers, and in terminal connector assemblies therefor.

SUMMARY

These needs and others are met by embodiments of the disclosed concept, which are directed to a terminal connector assembly for electrical switching apparatus such as, for example, circuit breakers. The terminal connector assembly is structured to enable the relatively quick and easy electrical connection of the power conductor of the circuit breaker to a wide variety of different electrical conductor types (e.g., without limitation, wires; cables) and configurations (e.g., without limitation, a single conductor; a plurality of conductors).

As one aspect of the disclosed concept, a terminal connector assembly is provided for an electrical switching apparatus. The electrical switching apparatus includes a molded casing and a power conductor. The terminal connector assembly comprises: an electrically conductive member including a connecting portion and a terminal portion disposed opposite and distal from the connecting portion, the connecting portion being structured to be electrically connected to the power conductor of the electrical switching apparatus; and a housing including a divider comprising a first side, a second side and an aperture extending from the first side of the divider to the second side of the divider, a plurality of walls extending perpendicularly outwardly from the first side of the divider to form a cavity, and a plurality of projections extending outwardly from the second side of the divider, the plurality of projections being structured to align the housing and the electrically conductive member with respect to the molded casing of the electrical switching apparatus. The connecting portion of the electrically conductive member extends through the aperture of the divider and outside of the housing. The remainder of the electrically conductive member is disposed within the cavity of the housing.

As another aspect of the disclosed concept, an electrical switching apparatus comprises: a molded casing including an interior, an exterior and opposing sidewalls extending outwardly from the molded casing to form a channel on the exterior of the molded casing; a power conductor extending from the interior of the molded casing into the channel; and a terminal connector assembly comprising: an electrically conductive member including a connecting portion and a terminal portion disposed opposite and distal from the connecting portion, the connecting portion being electrically connected to the power conductor, and a housing including a divider comprising a first side, a second side and an aperture extending from the first side of the divider to the second side of the divider, a plurality of walls extending perpendicularly outwardly from the first side of the divider to form a cavity, and a plurality of projections extending outwardly from the second side of the divider, the plurality of projections cooperating with the opposing sidewalls of the molded casing to align the housing and the electrically conductive member with respect to the molded casing. The connecting portion of the electrically conductive member extends through the aperture of the divider of the terminal connector assembly toward the power conductor. The remainder of the electrically conductive member is disposed within the cavity of the housing of the terminal connector assembly.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
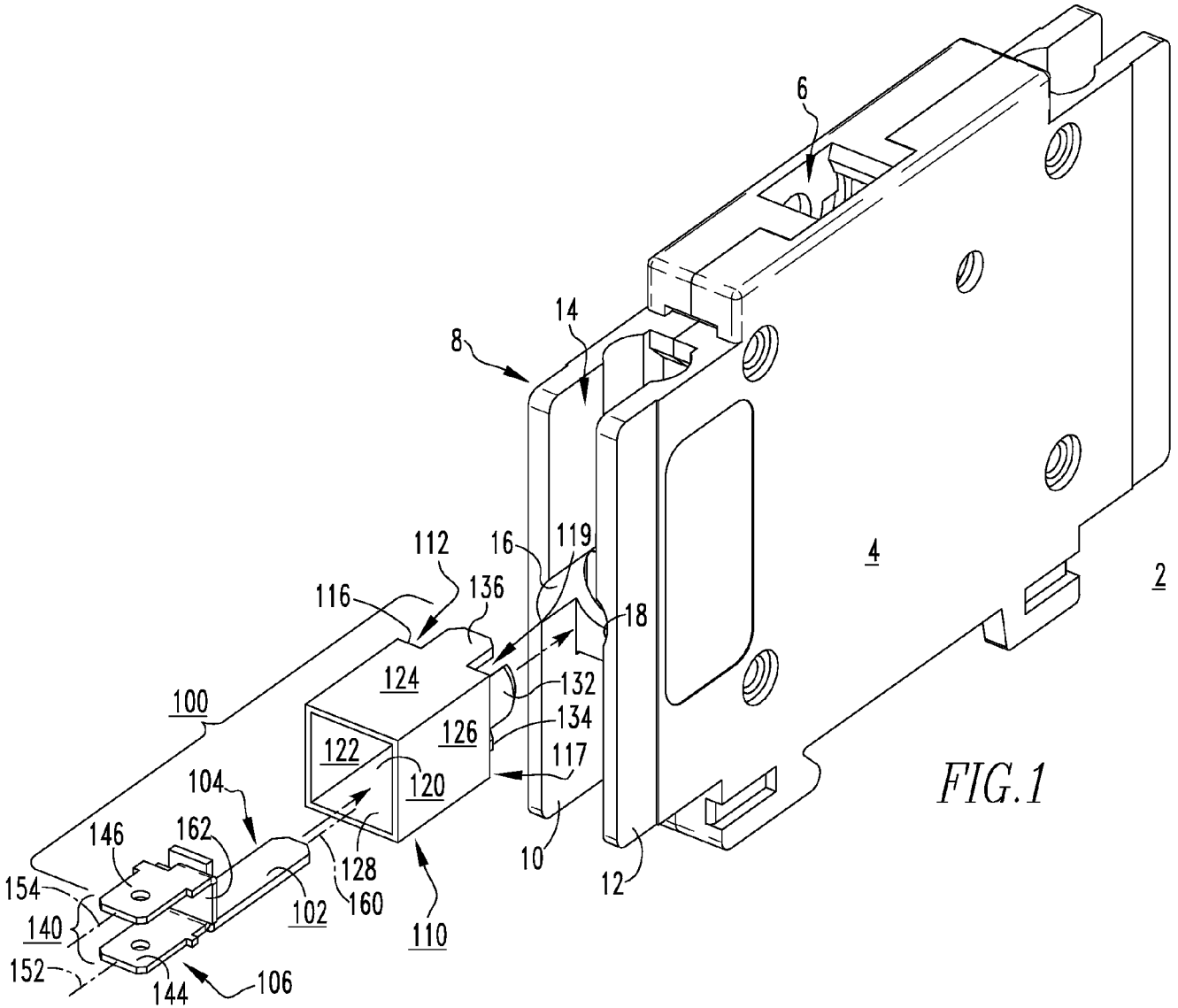
FIG. 1 is an exploded isometric view of a circuit breaker and terminal connector assembly therefor, in accordance with an embodiment of the disclosed concept.

For purposes of illustration, embodiments of the disclosed concept are shown and described in association with a terminal connector assembly for miniature single pole circuit breakers, although it will become apparent that they could also be applied to a wide range of other types of electrical switching apparatus, such as circuit breakers having two, three, four or more poles.

Directional phrases used herein, such as, for example, left, right, up, down, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws (e.g., without limitation, set screws), bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
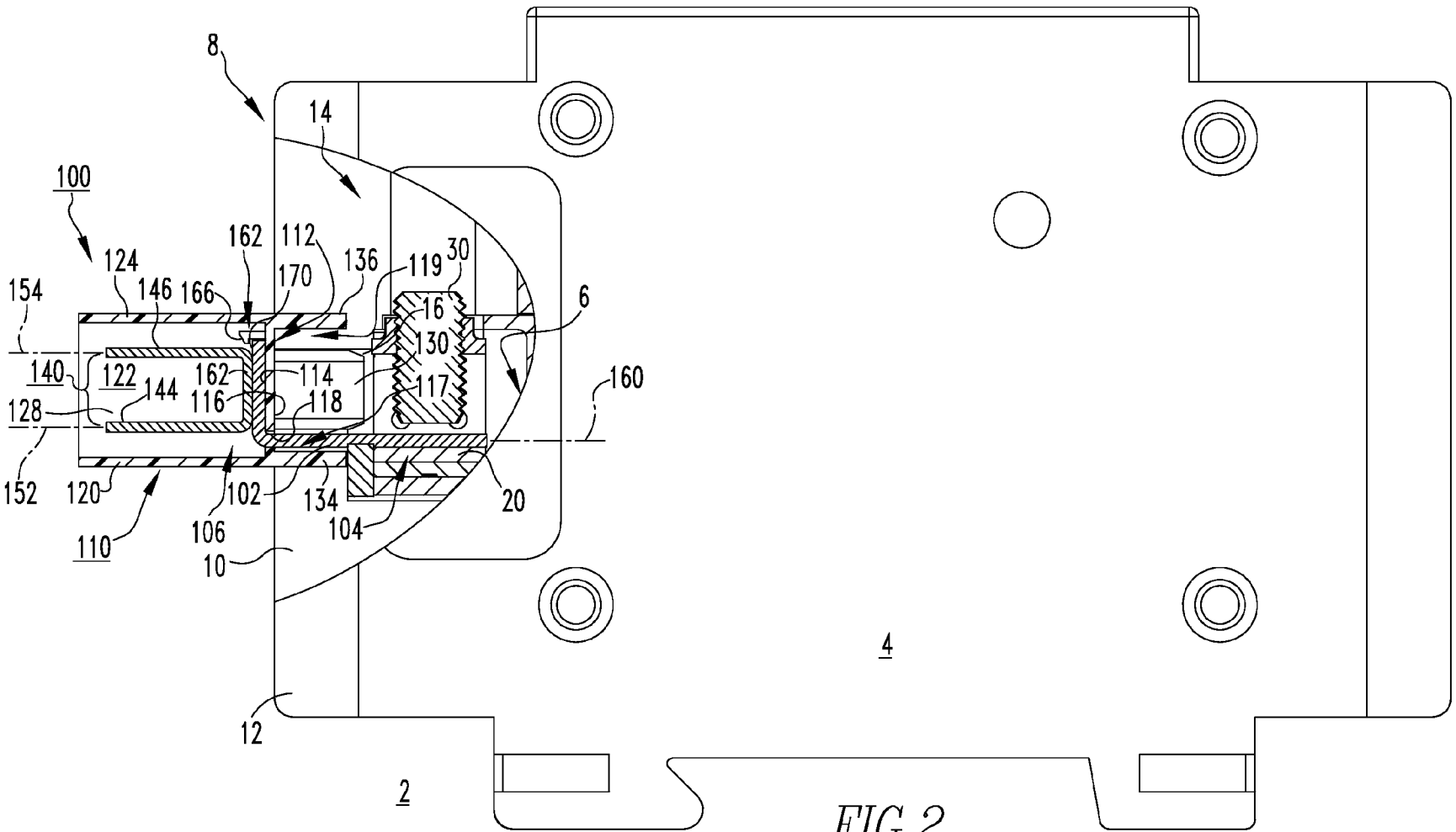
FIG. 2 is a side elevation view of the circuit breaker and terminal connector assembly therefor of FIG. 1, with a portion of the circuit breaker molded casing cut away to show hidden structures.

FIGS. 1 and 2 show a terminal connector assembly 100 for an electrical switching apparatus such as, for example and without limitation, a miniature circuit breaker 2. The miniature circuit breaker 2 shown and described herein includes a molded casing 4 having an interior 6, an exterior 8, and opposing sidewalls 10,12 extending outwardly from the molded casing 4 to form a channel 14 on the exterior 8, as best shown in FIG. 1. For economy of disclosure and simplicity of illustration, only one end (e.g., the load end) of the circuit breaker 2, and one terminal connector assembly 100 therefor, will be described in detail herein. It will, however, be appreciated that the opposite end (e.g., the line end) of the circuit breaker 2 could have a substantially similar structure and, therefore, could also employ the disclosed terminal connector assembly 100, if desired. It will further be appreciated that, although a single pole circuit breaker 2 is shown, that one or more of the disclosed terminal connector assemblies 100 could be employed in any suitable number and/or configuration with a multi-pole circuit breaker (not shown), for example and without limitation, where a plurality of circuit breakers 2 of the type shown and described herein are coupled together side-by-side (not shown).

As shown in FIG. 2, in which a portion of the circuit breaker molded casing 4 has been cut away to show structures that would otherwise be hidden, the circuit breaker 2 further includes a power conductor 20, which extends from the interior 6 of the molded casing 4 into the aforementioned channel 14. In addition, the circuit breaker 2 includes a fastener such as, for example and without limitation, the set screw 30, shown. The set screw 30 is structured to electrically fasten the terminal connector assembly 100 to the power conductor 20 of the circuit breaker 2, as discussed in greater detail hereinbelow.

Figure 3:
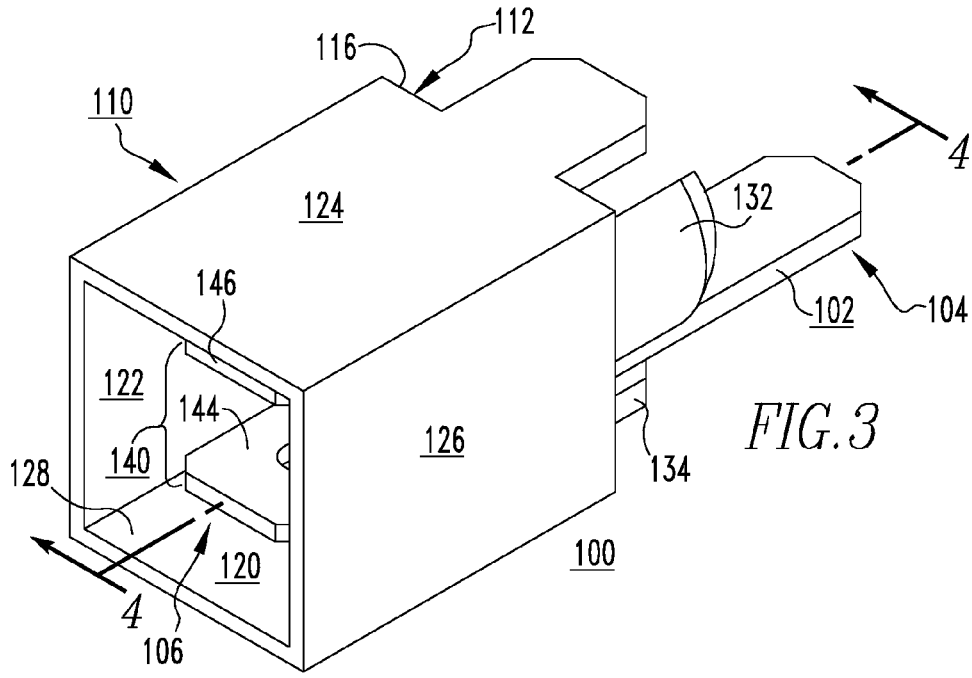
FIG. 3 is an isometric view of the terminal connector assembly of FIG. 2.
Figure 4:
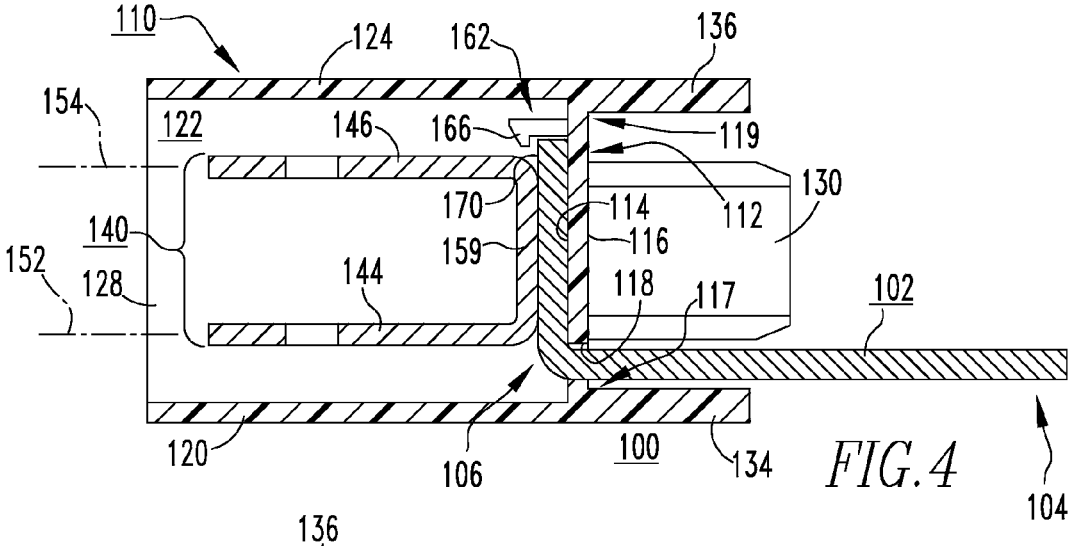
FIG. 4 is a section view taken along line 4-4 of FIG. 3.

Continuing to refer to FIGS. 1 and 2, and also to FIGS. 3 and 4, the terminal connector assembly 100 includes a conductive member 102 having a connecting portion 104 and a terminal portion 106 disposed opposite and distal from the connecting portion 104. The connecting portion 104 is structured to be electrically connected to the power conductor 20 of the circuit breaker 2, as shown in FIG. 2. The connecting portion 104 is also mechanically coupled (e.g., fastened) to the power conductor 20 (FIG. 2) by the fastener 30 (FIG. 2). The terminal connector assembly 100 further includes a housing 110 having a divider 112. The divider 112 includes first and second opposing sides 114,116 (both shown in FIGS. 2 and 4) and an aperture 118 (FIGS. 2, 4 and 5) extending therebetween. A plurality of walls, such as the first, second, third and fourth walls 120,122,124,126 shown in FIG. 3, extend perpendicularly outwardly from the first side 114 (FIGS. 2 and 4) of the divider 112 to form a cavity 128. A plurality of projections 130,132,134,136 (all shown in FIG. 5) extend outwardly from the second side 116 of the divider 112 to cooperate with the circuit breaker molded casing 4, as described hereinbelow. In this manner, the housing 110 and the electrically conductive member 102 are aligned with respect to the molded casing 4, as shown in FIG. 2.

As shown in FIGS. 2, 3 and 4, the connecting portion 104 of the electrically conductive member 102 extends through the aperture 118 (FIGS. 2 and 4) of the housing divider 112, and outside of the housing 110. The remainder 106 of the electrically conductive member 102 is disposed within the cavity 128 of the housing 110. In this manner, the disclosed terminal connector assembly 100 provides improved electrical insulation by disposing the terminal portion 106 of the electrically conductive member 102 entirely within the housing cavity 128, as opposed to prior art terminal connector assembly designs (not shown) in which a substantial portion of the electrically conductive member is disposed outside of the housing. For example, the electrically conductive member disclosed in U.S. Pat. No. 6,781,491, previously discussed, except for the stabs thereof, is disposed on the exterior of the housing. More specifically, as shown in FIG. 4, the connecting portion 104 (see also connecting portion 204 of FIGS. 6-8, and connecting portion 304 of FIGS. 9 and 10) of the electrically conductive member 102 extends perpendicularly outwardly from the second side 116 of the divider 112, whereas the terminal portion 106 (see also terminal portion 206 of FIGS. 7 and 8, and terminal portion 306 of FIGS. 9 and 10) is disposed on the first side 114 of the divider 112, within the housing cavity 128. In the example of FIG. 4, the terminal portion 106 is perpendicular with respect to the connecting portion 104, and is parallel to the divider 112, such that the electrically conductive member 102 is generally L-shaped. It will be appreciated, however, that the electrically conductive member 302,303 could alternatively be generally T-shaped, as shown in FIGS. 9 and 10. In the example of FIGS. 9 and 10, two generally L-shaped members are joined (e.g., without limitation, welded; brazed) together in a back-to-back relationship to be generally T-shaped.

The terminal portion 106 of the electrically conductive member 102 includes a number of terminals 140 (see also terminals 240,242 discussed hereinbelow with respect to FIGS. 7 and 8, and terminals 340,342 discussed hereinbelow with respect to FIGS. 9 and 10). Each of the terminals 140, includes a plurality of generally planar stabs 144,146, which extend perpendicularly outwardly from the terminal portion 106. Preferably, each of the generally planar stabs 144,146 is disposed in a plane 152,154, respectively, which is parallel with respect to a plane 160 of the connecting portion 104 of the electrically conductive member 102. The terminals in the example terminal connector assemblies 100 (FIGS. 1-5), 200 (FIGS. 6-8), 300 (FIGS. 9 and 10) are formed by way of generally U-shaped members 140 (FIGS. 1, 2 and 4), 240,242 (partially shown in FIG. 7; see also FIG. 8), 340,342 (FIGS. 9 and 10).

Figure 6:
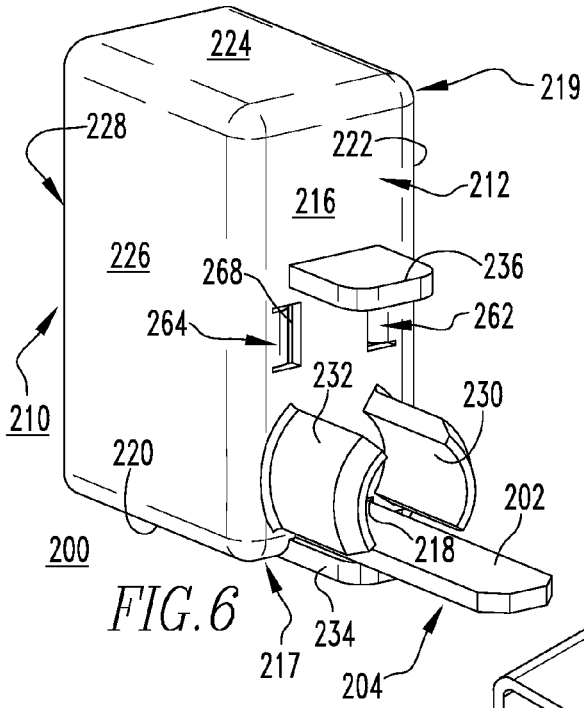
FIG. 6 is an isometric view of the interior side of a terminal connector assembly, in accordance with another embodiment of the disclosed concept.
Figure 7:
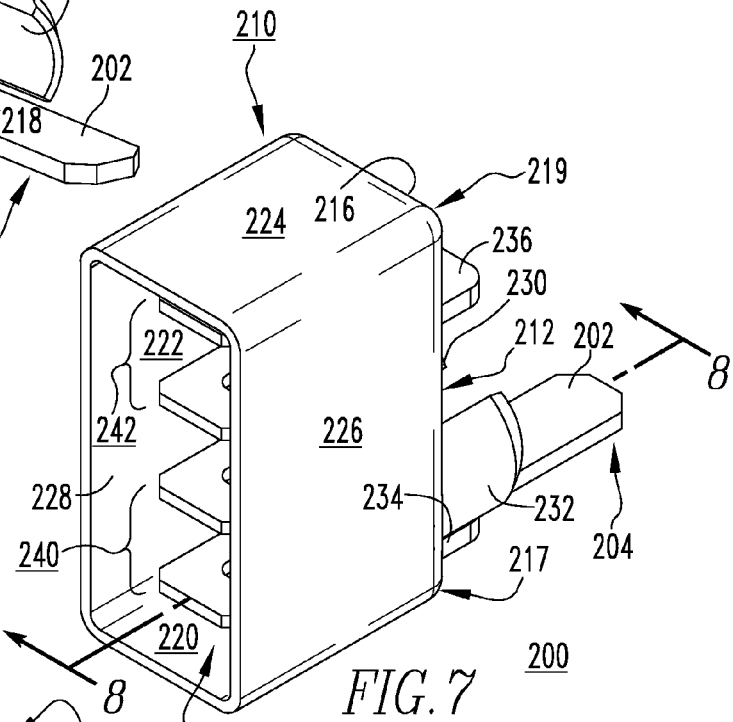
FIG. 7 is an isometric view of the exterior side of the terminal connector assembly of FIG. 6.
Figure 8:
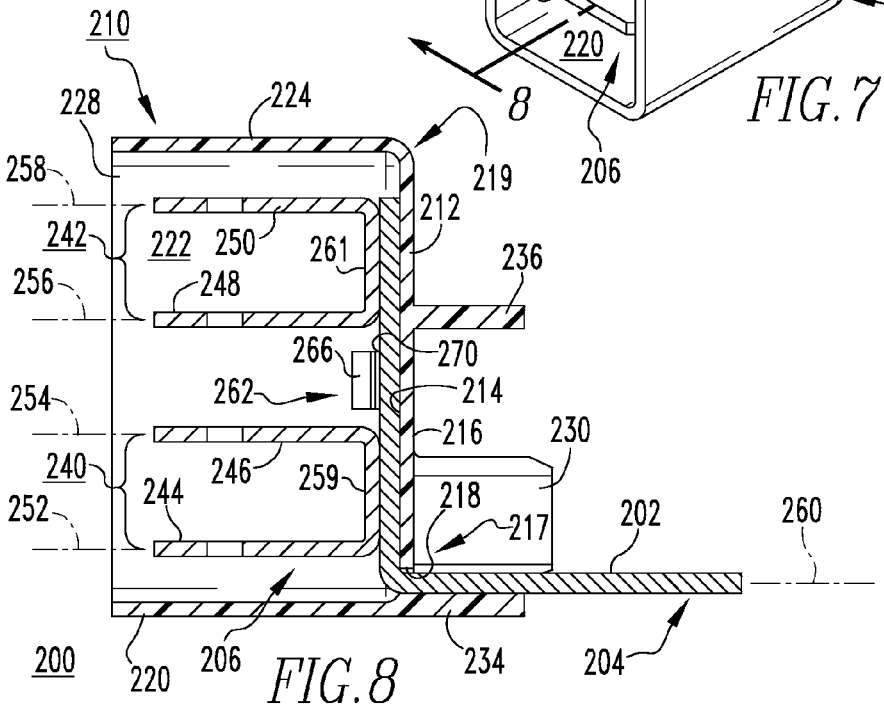
FIG. 8 is a section view taken along line 8-8 of FIG. 7.
Figure 9:
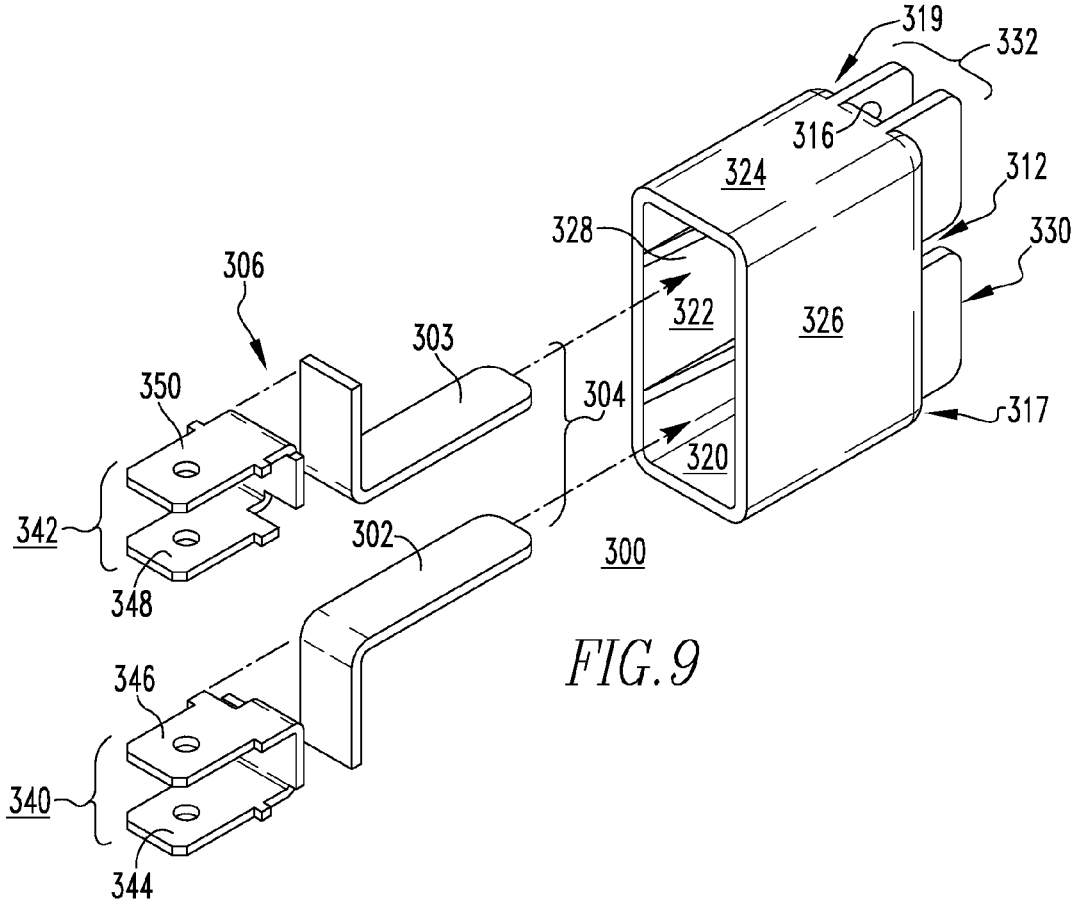
FIG. 9 is an exploded isometric view of a terminal connector assembly, in accordance with another embodiment of the disclosed concept.
Figure 10:
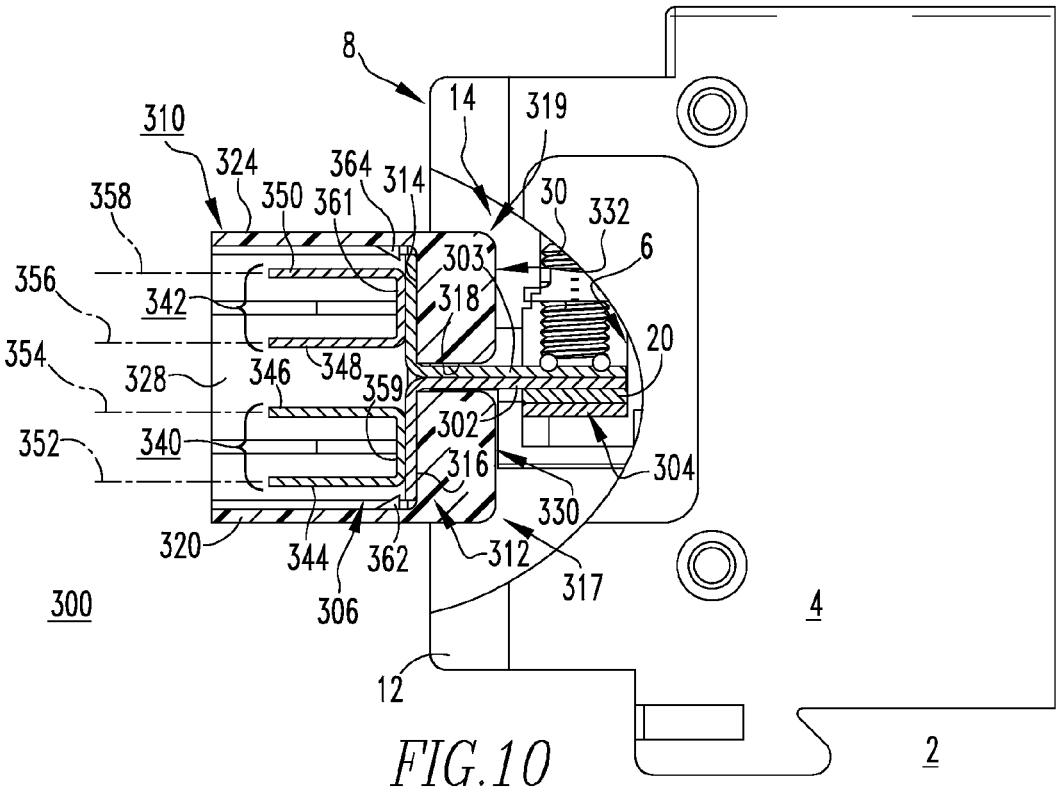
FIG. 10 is a side elevation view of a circuit breaker employing the terminal connector assembly of FIG. 9, with a portion of the circuit breaker molded casing cut away to show hidden structures.

As shown in FIGS. 1, 2 and 4, each generally U-shaped member 140 includes a base 159 (see also bases 259,261 of generally U-shaped members 240,242, respectively, in FIG. 8, and bases 359,361 of generally U-shaped members 340, 342, respectively, in FIGS. 9 and 10) and an opposing pair of the aforementioned generally planar stabs 144,146 (see also generally planar stabs 244,246 of generally U-shaped member 240, and generally planar stabs 248,250 of generally U-shaped member 242 of FIG. 8; see also generally planar stabs 344,346 of generally U-shaped member 340 and generally planar stabs 348,350 of generally U-shaped member 342 of FIGS. 9 and 10), each of which extends outwardly from a corresponding portion of the base 162. In the examples shown and described herein, the base 162 is mechanically coupled (e.g., without limitation, welded; brazed) and electrically connected to the terminal portion 106 of the electrically conductive member 102. It will, however, be appreciated that the terminals could have any known or suitable alternative number and/or configuration (not shown), without departing from the scope of the disclosed concept. For example and without limitation, the generally planar stabs (e.g., 144,146 (FIGS. 1-4); 244,246,248,250 (FIG. 8); 344, 346,348,350 (FIGS. 9 and 10)) could be formed from and, therefore be integral with, the terminal portion 106 (FIGS. 1-4), 206 (FIGS. 7 and 8), 306 (FIGS. 9 and 10) of the electrically conductive member 102 (FIGS. 1-4), 202 (FIGS. 6-8), 302,303 (FIGS. 9 and 10) such that the entire electrically conductive member 102 (FIGS. 1-4), 202 (FIGS. 6-8), 302, 303 (FIGS. 9 and 10) including the terminal stabs 144,146 (FIGS. 1-4), 244,246,248,250 (FIGS. 7 and 8), 344,346,348, 350 (FIGS. 9 and 10) thereof, are made from one continuous piece of material (not shown). Thus, it will be appreciated that FIGS. 6-8 show one non-limiting alternative embodiment of a terminal connector assembly 200 in accordance with the disclosed concept, wherein the terminal portion 206 of the electrically conductive member 202 includes a plurality generally U-shaped terminals 240,242 (FIGS. 7 and 8), wherein the stabs 244,246,248,250 are preferably disposed in planes 252,254,256,258, respectively, which extend perpendicularly outwardly from the terminal portion 206 and are parallel with respect to a plane 260 of the connecting portion 204 of the electrically conductive member 202, as shown in FIG. 8. Similarly, FIGS. 9 and 10 show an alternative non-limiting embodiment of a terminal connector assembly 300, wherein the terminal portion 306 of the electrically conductive member 302,303 includes a plurality of generally U-shaped terminals 340,342, wherein the stabs 344,346,348,350 are preferably disposed in planes 352,354,356,358, respectively, which extend perpendicularly outwardly from the terminal portion 306 and parallel with respect to a plane 360 of the connecting portion 304 of the generally T-shaped electrically conductive member 302,303.

As shown in FIG. 4, the divider 112 of the terminal connector assembly housing 110 further includes a number of resilient hooks 162 (one hook 162 is shown in FIG. 4; see also the pair of opposing hooks 262,264 of the terminal connector assembly 200 of FIG. 6), which extend outwardly from the first side 114 of the divider 112 within the cavity 128 of the housing 110. The resilient hook 162 of FIG. 4 includes a barb 166 structured to engage and retain a corresponding portion (e.g., without limitation, 170) of the terminal portion 106 of the electrically conductive member 102, thereby securing the electrically conductive member 102 in the desired orientation with respect to the housing 110. It will, however, be appreciated that any known or suitable alternative number and/or configuration of resilient hooks, or other suitable securing mechanism(s) (not shown) could be employed, without departing from the scope of the disclosed concept. For example and without limitation, as shown in FIGS. 6 and 8, rather than the aforementioned single resilient hook 162 (FIGS. 2 and 4), the terminal connector assembly 200 includes a pair of opposing resilient hooks 262,264. Resilient hook 262 has a barb 266 (FIG. 8) and resilient hook 264 has a barb 268 (FIG. 6), each of which engages and secures a corresponding portion (e.g., without limitation 270) of the terminal portion 206 of the electrically conductive member 202, as shown in FIG. 8. In the example of FIG. 10, the terminal connector assembly 30 includes opposing hooks or barbs 362,364 extending inwardly from the bottom (e.g., from the perspective of FIG. 10) and top (e.g., from the perspective of FIG. 10) walls 320,324, respectively, to maintain the position of the electrically conductive member 302, 303 at or about the first side 314 (e.g., inner side) of the divider 312 of the housing 310.

Figure 5:
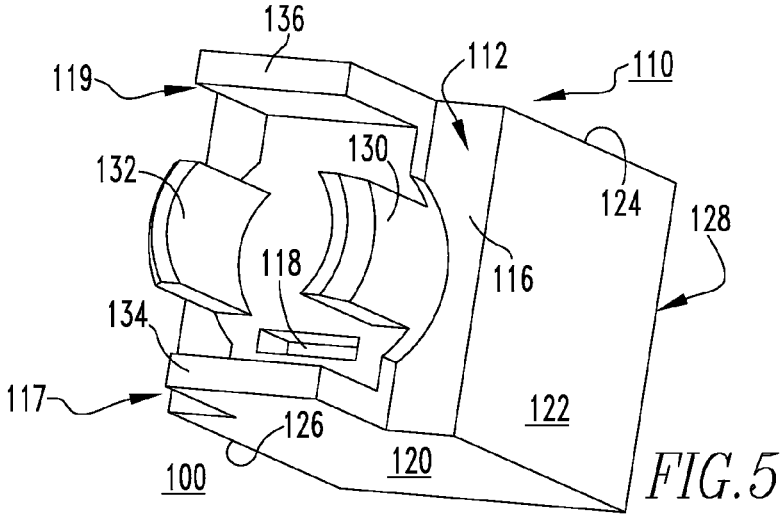
FIG. 5 is an isometric view of the terminal connector assembly of FIG. 4, with the electrically conductive terminal member removed.

Referring again to FIG. 1, one of the opposing sidewalls 10 of the molded casing 4 of the circuit breaker 2 includes a first arcuate recess 16, and the other one of the opposing sidewalls 12 includes a second arcuate recess 18. The plurality of projections 130,132,134,136 (all shown in FIG. 5) on the second side 116 of the housing divider 112 includes a first arcute projection 130 (FIGS. 2, 4 and 5) and a second arcuate projection 132 (FIGS. 1,3 and 5) disposed opposite the first arcuate projection 130 (FIGS. 2, 4 and 5). When the terminal connector assembly 100 is coupled to the circuit breaker molded casing 4, as shown in FIG. 2, the first arcuate projection 130 is disposed in the first arcuate recess 16, as shown, and the second arcuate projection 132 (FIG. 1) is disposed in the second arcuate recess 18 (FIG. 1). Thus, the arcuate projections 130,132 (both shown in FIG. 5) cooperate with the arcuate recesses 16,18 (both shown in FIG. 1) to maintain the desired position of the terminal connector assembly 100 with respect to the circuit breaker 2. It will be appreciated that the arcuate projections 130,132 (both shown in FIG. 5) could, but need not necessarily, be sized and arranged so as to provide an interference fit with respect to the opposing sidewalls 10,12 of the circuit breaker molded casing 4, thereby further securing the terminal connector assembly 100 with respect thereto. It will also be appreciated that the terminal connector assembly 200 of FIGS. 6-8 also includes opposing arcuate projections 230,232 (both shown in FIG. 6). However, the terminal connector assembly 30 of FIGS. 9 and 10 has opposing pairs of upright projections 330,332 extending outwardly from the second side 316 (e.g., exterior side) of the divider 312, as best shown in FIG. 9.

In addition to the arcuate projections 130,132 (both shown in FIG. 5), the housing 110 of the example terminal connector assembly 100 further includes first and second tabs 134,136 (see also tabs 234,236 of terminal connector assembly 200 of FIGS. 6-8). In the embodiment of FIGS. 1-5, the first tab 134 extends outwardly from the second side 116 of the divider 112 at or about the first end 117 of the divider 112, and the second tab 136 extends outwardly from the second side 116 of the divider 112 at or about the second end 119 of the divider 112, opposite the first tab 134. However, it will be appreciated that the tabs 134,136 could extend outwardly from the second side 116 of the divider 112 at suitable alternative locations. For example and without limitation, the second tab 236 of the terminal connector assembly 200 of the embodiment of FIGS. 6-8 extends outwardly from the second side 216 of the divider 212 at a location in between the first and second ends 217,219 of the divider 212. In any event, the tabs 134,136 (FIGS. 1-5), 234,236 (FIGS. 6-8) are structured to be disposed between the opposing sidewalls 10,12 (FIGS. 1 and 2) of the circuit breaker molded casing 4 (FIGS. 1 and 2) to further align the terminal connector assembly 100 (FIGS. 1-5), 200 (FIGS. 6-8) with respect to the molded casing 4 (FIGS. 1 and 2), when the terminal connector assembly 100 is coupled to the molded casing 4, as shown, for example, in FIG. 2. Alternatively, in the example of FIGS. 9 and 10, the pairs of upright projections 330,332 serve this purpose of establishing and maintaining alignment.

Continuing to refer to FIG. 2, it will be appreciated that the example terminal connector assembly 100 is further secured to the circuit breaker 2 by the aforementioned fastener 30. Specifically, the power conductor 20 of the circuit breaker 2 and the connecting portion 104 of the electrically conductive member 102 of the terminal connector assembly 100 are both substantially flat. Thus, when the terminal connector assembly 100 is mechanically coupled and electrically connected to the circuit breaker 2, as shown in FIG. 2, the substantially flat connecting portion 104 extends into the channel 14 of the circuit breaker molded casing 4 and overlays a corresponding portion of the substantially flat power conductor 20, as shown. The fastener 30 is then tightened (e.g., threaded downwardly from the perspective of FIG. 2) to fasten (e.g., without limitation, clamp together) the connecting portion 104 to the power conductor 20.

Accordingly, the disclosed terminal connector assembly 100 (FIGS. 1-5), 200 (FIGS. 6-8), 300 (FIGS. 9 and 10) provides a mechanism for relatively quickly and easily converting the traditional terminal (e.g., power terminal 20) of the circuit breaker 2 into a quick-connect assembly having a plurality of stabs (e.g., without limitation, 140,142 (FIGS. 1-4); 244,246,248,250 (FIG. 8); 344,346,348,350 (FIGS. 9 and 10)) to accommodate a wide variety of different electrical conductor types (e.g., without limitation, wires; cables) (not shown) and configurations (e.g., without limitation, a single conductor (not shown); a plurality of conductors (not shown)).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A terminal connector assembly for an electrical switching apparatus, said electrical switching apparatus including a molded casing and a power conductor, said terminal connector assembly comprising:

an electrically conductive member including a connecting portion and a terminal portion disposed opposite and distal from the connecting portion, the connecting portion being structured to be electrically connected to the power conductor of said electrical switching apparatus; and a housing including a divider comprising a first side, a second side and an aperture extending from the first side of the divider to the second side of the divider, a plurality of walls extending perpendicularly outwardly from the first side of said divider to form a cavity, and a plurality of projections extending outwardly from the second side of said divider, said plurality of projections being structured to align said housing and said electrically conductive member with respect to the molded casing of said electrical switching apparatus, wherein the connecting portion of said electrically conductive member extends through the aperture of said divider and outside of said housing, and wherein the remainder of said electrically conductive member is disposed within the cavity of said housing.

2. The terminal connector assembly of claim 1 wherein the connecting portion of said electrically conductive member extends perpendicularly outwardly from the second side of said divider; wherein the terminal portion of said electrically conductive member is perpendicular with respect to the connecting portion; and wherein the terminal portion is disposed parallel to said divider on the first side of said divider within the cavity of said housing.

3. The terminal connector assembly of claim 2 wherein the terminal portion of said electrically conductive member includes a number of terminals; wherein each of said number of terminals comprises a plurality of generally planar stabs; wherein each of said generally planar stabs is disposed in a plane; wherein the connecting portion of said electrically conductive member is disposed in a plane; wherein each of said plurality of generally planar stabs extends perpendicularly outwardly from the terminal portion; and wherein the plane of each of said generally planar stabs is parallel with respect to the plane of the connecting portion of said electrically conductive member.

4. The terminal connector assembly of claim 3 wherein said number of terminals is a number of generally U-shaped members; wherein each of said number of generally U-shaped members includes a base and an opposing pair of said generally planar stabs; wherein each generally planar stab of said opposing pair of generally planar stabs extends outwardly from a corresponding portion of the base; and wherein the base is mechanically coupled and electrically connected to the terminal portion of said electrically conductive member.

5. The terminal connector assembly of claim 4 wherein said number of generally U-shaped members is a plurality of generally U-shaped members.

6. The terminal connector assembly of claim 2 wherein said divider further comprises a number of resilient hooks; wherein each of said number of resilient hooks extends outwardly from the first side of said divider within the cavity of said housing; and wherein each of said number of resilient hooks engages a corresponding portion of the terminal portion of said electrically conductive member, thereby securing said electrically conductive member with respect to said housing.

7. The terminal connector assembly of claim 1 wherein the molded casing of said electrical switching apparatus comprises an interior, an exterior and opposing sidewalls extending outwardly from the molded casing to form a channel on the exterior; and wherein each of said plurality of projections of said housing is structured to cooperate with a corresponding one of said opposing sidewalls of the molded casing.

8. The terminal connector assembly of claim 7 wherein one of said opposing sidewalls of the molded casing includes a first arcuate recess; wherein the other one of said opposing sidewalls includes a second arcuate recess; wherein said plurality of projections of said housing comprise a first arcuate projection and a second arcuate projection disposed opposite said first arcuate projection; wherein said first arcuate projection is structured to be disposed in said first arcuate recess; and wherein said second arcuate projection is structured to be disposed in said second arcuate recess.

9. The terminal connector assembly of claim 8 wherein said divider of said housing further comprises a first end and a second end disposed opposite and distal from the first end of said divider; wherein said plurality of projections of said housing further comprise a first tab and a second tab; wherein said first tab extends outwardly from the second side of said divider at or about the first end of said divider; wherein said second tab extends outwardly from the second side of said divider opposite said first tab; and wherein said first tab and said second tab are structured to be disposed between said opposing sidewalls of the molded casing of said electrical switching apparatus.

10. The terminal connector assembly of claim 7 wherein said plurality of projections of said housing comprise a first pair of opposing upright tabs and a second pair of opposing upright tabs; wherein the connecting portion of said electrically conductive member extends between said first pair of opposing upright tabs and said second pair of opposing upright tabs; and wherein said first pair of opposing upright tabs and said second pair of opposing upright tabs are structured to be disposed between said opposing sidewalls of the molded casing.

11. An electrical switching apparatus comprising:

a molded casing including an interior, an exterior and opposing sidewalls extending outwardly from the molded casing to form a channel on the exterior of the molded casing;

a power conductor extending from the interior of the molded casing into said channel; and a terminal connector assembly comprising:

an electrically conductive member including a connecting portion and a terminal portion disposed opposite and distal from the connecting portion, the connecting portion being electrically connected to the power conductor, and a housing including a divider comprising a first side, a second side and an aperture extending from the first side of the divider to the second side of the divider, a plurality of walls extending perpendicularly outwardly from the first side of said divider to form a cavity, and a plurality of projections extending outwardly from the second side of said divider, said plurality of projections cooperating with said opposing sidewalls of the molded casing to align said housing and said electrically conductive member with respect to the molded casing, wherein the connecting portion of said electrically conductive member extends through the aperture of said divider of said terminal connector assembly toward the power conductor, and wherein the remainder of said electrically conductive member is disposed within the cavity of said housing of said terminal connector assembly.

12. The electrical switching apparatus of claim 11 wherein the connecting portion of said electrically conductive member of said terminal connector assembly extends perpendicularly outwardly from the second side of said divider outside of said housing of said terminal connector assembly; wherein the terminal portion of said electrically conductive member is perpendicular with respect to the connecting portion; and wherein the terminal portion is disposed parallel to said divider on the first side of said divider with the cavity of said housing.

13. The electrical switching apparatus of claim 12 wherein the terminal portion of said electrically conductive member includes a number of terminals; wherein each of said number of terminals comprises a plurality of generally planar stabs; wherein each of said generally planar stabs is disposed in a plane; wherein the connecting portion of said electrically conductive member is disposed in a plane; wherein each of said plurality of generally planar stabs extends perpendicularly outwardly from the terminal portion; and wherein the plane of each of said generally planar stabs is parallel with respect to the plane of the connecting portion of said electrically conductive member.

14. The electrical switching apparatus of claim 13 wherein said number of terminals is a number of generally U-shaped members; wherein each of said number of generally U-shaped members includes a base and an opposing pair of said generally planar stabs; wherein each generally planar stab of said opposing pair of generally planar stabs extends outwardly from a corresponding portion of the base; and wherein the base is mechanically coupled and electrically connected to the terminal portion of said electrically conductive member.

15. The electrical switching apparatus of claim 14 wherein said number of generally U-shaped members is a plurality of generally U-shaped members.

16. The electrical switching apparatus of claim 12 wherein said divider of said terminal connector assembly further comprises a number of resilient hooks; wherein each of said number of resilient hooks extends outwardly from the first side of said divider within the cavity of said housing of said terminal connector assembly; and wherein each of said number of resilient hooks engages a corresponding portion of the terminal portion of said electrically conductive member, thereby securing said electrically conductive member with respect to said housing.

17. The electrical switching apparatus of claim 11 wherein one of said opposing sidewalls of the molded casing includes a first arcuate recess; wherein the other one of said opposing sidewalls includes a second arcuate recess; wherein said plurality of projections of said housing of said terminal connector assembly comprise a first arcuate projection and a second arcuate projection disposed opposite said first arcuate projection; wherein said first arcuate projection is disposed in said first arcuate recess; and wherein said second arcuate projection is disposed in said second arcuate recess.

18. The electrical switching apparatus of claim 17 wherein said divider of said housing of said terminal connector assembly further comprises a first end and a second end disposed opposite and distal from the first end of said divider; wherein said plurality of projections of said housing further comprise a first tab and a second tab; wherein said first tab extends outwardly from the second side of said divider at or about the first end of said divider; wherein said second tab extends outwardly from the second side of said divider opposite said first tab; and wherein said first tab and said second tab are disposed between said opposing sidewalls of the molded casing.

19. The electrical switching apparatus of claim 18 wherein the power conductor of said electrical switching apparatus and the connecting portion of said electrically conductive member of said terminal connector assembly are substantially flat; wherein the substantially flat connecting portion extends into said channel of the molded casing in order to overlay a corresponding portion of the substantially flat power conductor; wherein the molded casing further comprises a fastener; and wherein said fastener fastens the connecting portion to the power conductor.

20. The electrical switching apparatus of claim 17 wherein said plurality of projections of said housing comprise a first pair of opposing upright tabs and a second pair of opposing upright tabs; wherein the connecting portion of said electrically conductive member extends between said first pair of opposing upright tabs and said second pair of opposing upright tabs; and wherein said first pair of opposing upright tabs and said second pair of opposing upright tabs are structured to be disposed between said opposing sidewalls of the molded casing.

21. The electrical switching apparatus of claim 11 wherein said electrical switching apparatus is a circuit breaker; wherein the plurality of walls of said housing of said terminal connector assembly are first, second, third and fourth walls extending outwardly from the first side of said divider of said housing to form the cavity of said housing; and wherein the terminal portion of said electrically conductive member is disposed within the cavity of said housing, thereby being electrically insulated from the remainder of said circuit breaker.

* * * * *